US005447680A

United States Patent [19]

Bowden

[11] Patent Number: 5,447,680

[45] Date of Patent: Sep. 5, 1995

[54] FIBER-REINFORCED, TITANIUM BASED COMPOSITES AND METHOD OF FORMING WITHOUT DEPLETION ZONES

[75] Inventor: David M. Bowden, St. Louis County, Mo.

[73] Assignee: McDonnell Douglas Corporation, St. Louis, Mo.

[21] Appl. No.: 210,915

[22] Filed: Mar. 21, 1994

[51] Int. Cl.[6] ..... B22F 3/14

[52] U.S. Cl. ..... 419/4; 419/10; 419/17; 419/5; 419/8

[58] Field of Search ..... 428/546, 549, 552, 568, 428/569, 567; 410/418; 148/516, 559; 419/4, 5, 8, 10, 17; 29/890.11

[56] References Cited

U.S. PATENT DOCUMENTS

| | | | |
|---|---|---|---|
| 4,292,077 | 9/1981 | Blackburn et al. | 75/175.5 |
| 4,716,020 | 12/1987 | Blackburn et al. | 420/418 |
| 4,928,585 | 12/1990 | Ritter et al. | 428/614 |
| 5,017,438 | 5/1991 | Semers et al. | 428/614 |
| 5,030,277 | 2/1991 | Eylon et al. | 75/229 |
| 5,032,357 | 7/1991 | Rowe | 420/418 |
| 5,045,407 | 9/1991 | Ritter | 428/614 |
| 5,104,460 | 4/1992 | Smith, Jr. et al. | 148/11.5 F |
| 5,118,029 | 6/1992 | Smith, Jr. et al. | 228/121 |

*Primary Examiner*—Donald P. Walsh
*Assistant Examiner*—John N. Greaves
*Attorney, Agent, or Firm*—Veo Peoples, Jr.

[57] ABSTRACT

Microcracks in fiber-reinforced/titanium aluminide matrix composite materials are inhibited by employing a matrix comprising a titanium aluminide alloy having (1) from ten to twelve atomic percent niobium and (2) a critical admixture of from two to six atomic percent of a member selected from a group consisting of molybdenum, tungsten and vanadium. The tendency of the fiber/matrix interfacial reaction to increase the stability of the Alpha 2 phase in the matrix adjacent to the interface and the tendency to form a "beta phase depletion zone" are unexpectedly negated. Suppression of the beta depletion zone formation inhibits the formation and growth of interfacial microcracks, and allows the fabrication of crack-free titanium matrix composite materials. The need for an extraneous beta phase stabilization treatment at the fiber/matrix interface is eliminated.

7 Claims, 5 Drawing Sheets

10 U

10 U

FIBER-REINFORCED, TITANIUM BASED COMPOSITES AND METHOD OF FORMING WITHOUT DEPLETION ZONES

BACKGROUND OF THE INVENTION

1. Field of the Invention

The present invention relates generally to composites having a titanium aluminide matrix, reinforced by, for example, silicon carbide fibers or filaments. More particularly, it relates to improvements inhibiting formation of microcracks in the titanium aluminide matrix.

2. Background of the Prior Art

In recent years there has been a dramatic increase in the performance requirements demanded from aerospace structural materials. Inasmuch as composite materials made from a titanium base alloy, reinforced with high strength/high stiffness filaments or fibers, have been shown to exhibit very high strength properties in relation to their weight and have the potential to extend the maximum use temperature of titanium well into the range of 650° to 750° C. (which temperatures exist in many advanced air frame and turbine engine environments), such composites have been the subject of intense study as a most promising class of materials.

However, with few exceptions, the tensile strength of the earlier titanium composite materials has not measured up to the values theoretically possible vis-a-vis the rule-of-mixtures (ROM) values. Furthermore, the fatigue properties of the material are poor.

Titanium aluminides, based on their ordered Alpha 2 $Ti_3Al$ phase, are currently considered to be one of the most promising group of titanium alloys for fiber-reinforced composites. However, the $Ti_3Al$ ordered phase is very brittle at lower temperatures and has low resistance to cracking under cyclic thermal conditions. Consequently, groups of alloys based on the $Ti_3Al$ phase, modified with Beta stabilizing elements, such as niobium, molybdenum, and vanadium have been contemplated to improve room temperature ductility and to improve resistance to cracking. However, these benefits are accompanied by decreases in high temperature properties. Although the Beta stabilizer niobium, at a maximum of about 11 atomic percent (21% by weight) has been preferred over other Beta stabilizers for optimum balance of low and high temperature properties in unreinforced matrices, even niobium is problematic in fiber-reinforced composites.

Where titanium aluminide matrices (even modified with niobium) are reinforced with, for example, silicon carbide fibers, Beta phase depletion zones have been observed at the fiber/matrix interface. The Beta depletion zone surrounds the fiber as an essentially pure Alpha 2 region having inherently low resistance to thermal cracking. Thus, during high temperature bonding between the fiber and the matrix, microcracks which initiate in the reaction zone, can propagate through the Beta depletion zone and on through the composite.

Until now, the Beta depletion zone has been attributed to interfacial reaction products serving to deplete the volume of niobium at the vicinity of the fiber/matrix interface. Accordingly, additional sacrificial amounts of niobium, either in powder or plasma form, have been sprayed onto the surface of the silicon carbide fibers to replenish the depleted volume of niobium.

For example, U.S. Pat. No. 4,978,585 discloses a method for vaporizing aluminum from the alloy powder prior to consolidating the alloy powder and the fibers. This method therefore enhances the relative proportion of niobium in the matrix and enhances the volume of Beta crystals.

U.S. Pat. Nos. 5,017,438 and 5,045,407 disclose methods for plasma spraying pure niobium or niobium alloy powder onto the fibers, followed by consolidation of the niobium plasma sprayed fibers with additional niobium doped titanium alloy matrix powder. A one micron thick diffusion zone of, for example, pure niobium surrounds each fiber, into which there is some titanium alloy interdiffusion.

U.S. Pat. No. 5,030,277 discloses coating silicon carbide fibers with a sacrificial excess of, preferably, niobium, mixed with polystyrene binder. Then consolidation of the coated fibers with normal alloy powder proceeds. This process also enhances the volume fraction of Beta stabilizing material at the fiber/matrix interface.

These prior art processes have several drawbacks. First of all, where the fibers are coated with niobium-doped titanium alloy powders having excess niobium, the volume fraction of Beta phase may increase, but the thermodynamic stability at the fiber/matrix interface continues to favor formation of Alpha 2 phase materials. Since the stability does not shift towards the Beta phase, there remains an envelope of continuous Alpha 2 phase material, i.e., a Beta depletion zone. Although the Beta depletion zone is of less volume than exists without coating the fiber with the sacrificial niobium alloy, there is, all the same, a continuous Alpha 2 phase at the interface.

Secondly, where pure niobium metal powder, or pure mixtures of Beta solute powders are coated onto the fiber, even though there is some diffusion of titanium matrix material, the composite, at its interface, is constituted predominantly of the more dense transition metal, and niobium is particularly dense. Accordingly, there exists a different intermetallic structure at the interface, devoid of titanium intermetallic Beta constituents. This more dense material, although lacking pure Alpha 2, is all the same unsuitable for lightweight composite structure design where the less dense titanium intermetallic characteristics are desired.

Furthermore, the multiplicity of steps, such as conducting controlled evaporation, coating of the fibers, etc, is more cumbersome and less efficient than if no such steps were required.

Therefore, it is a principal object of the present invention to provide novel silicon carbide reinforced titanium composites.

It is a further object to provide such composites with the ordered alloys of $Ti_3Al$+niobium, but having stability shifted towards the Beta phase at the fiber/matrix interface.

It is an additional object of the present invention to provide novel fiber-reinforced titanium composite materials without a Beta depletion zone, but less dense and better suited for elevated temperature applications where lighter material is essential, as in, for example, turbine engines.

It is a further object of the present invention to negate the need for coating silicon carbide fibers with pure metal or alloy powders prior to consolidation with the principal alloy of the matrix.

It is a further principal object of the present invention to provide an improved, crack-free titanium aluminide, fiber-reinforced composite material.

SUMMARY OF INVENTION

In accordance with the present invention, there is provided a fiber reinforced composite material having $Ti_3Al$ matrix alloy, which alloy contains a critical admixture of transition metal solute elements including niobium, molybdenum, tungsten and vanadium in a particular relative proportion. The composite materials are surprisingly stabilized toward Beta phase continuity at the fiber/matrix interface, and thus eliminate Beta depletion zones without having to densify the composite at its interface with a heavier non-titanium alloy.

The reasons underlying this surprising Beta phase stabilization at the interface, without having to precoat the fibers nor exceed safe levels of niobium, are not completely understood. The reasons, in part, are believed to arise from my discovery that Beta depletion zones are not caused by volumetric depletion of niobium at the interface, and therefore are ineffectively addressed by mere volumetric concentration of the preferred prior art Beta stabilizing solute, niobium, or volumetric exclusion of $Ti_3Al$ at the fiber/matrix interface. But rather, I believe that the Beta depletion zones may instead be created by fiber constituents, especially carbon, diffusing from the reaction zone at the interface into the matrix, and I have discovered that the unexpected benefit of critical admixtures of heretofore non-preferred solutes into the alloy matrix can itself eliminate Beta depletion zones entirely. This stems from a shift, in thermodynamic stability, away from formation of continuous Alpha-2 at the interface and towards formation of continuous Beta phase by probably overwhelming the effect of carbon diffusion. A simpler method of manufacture, a lighter composite material, and a material having increased high temperature properties is thereby achieved.

a. as fabricated;

b. thermally exposed at 1000° C. for twenty-four hours;

c. thermally exposed at 1000° C. for forty-eight hours;

d. thermally exposed at 1000° C. for ninety-six hours.

Figure 3:
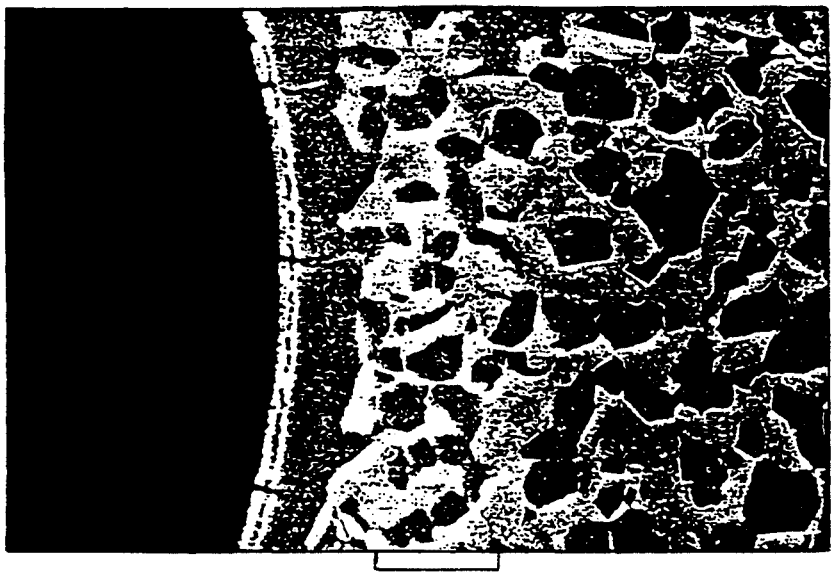

FIG. 3 is a micrograph of the interface formed between Ti-26Al-16Nb titanium aluminide matrix alloy and SCS-6 SiC fiber reinforcement.

Figure 4:
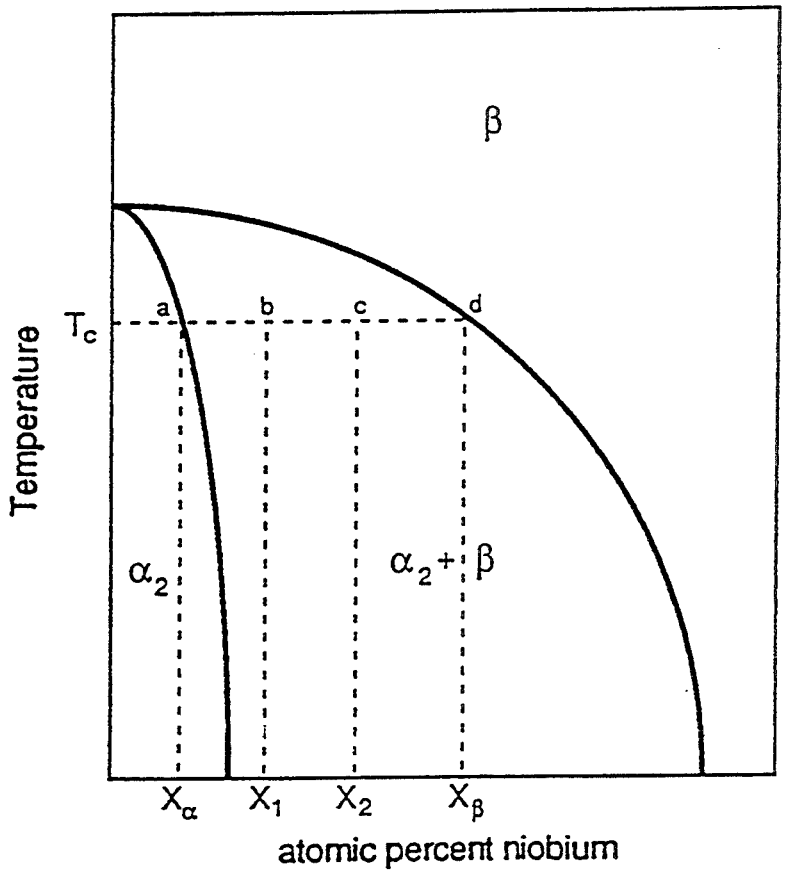

FIG. 4 is a pseudobinary by $Ti_3Al$-Nb phase diagram.

FIG. 5 is a micrograph of a preferred embodiment of the present invention showing the interface formed between Ti-25Al-11Nb-2.6Mo titanium aluminide alloy and SCS-6 SiC fiber reinforcement in which the following is illustrated:

a. arrest of interfacial cracks by Beta phase at the interface; and b. crack growth into the Alpha 2 phase of the matrix.

Figure 6B:
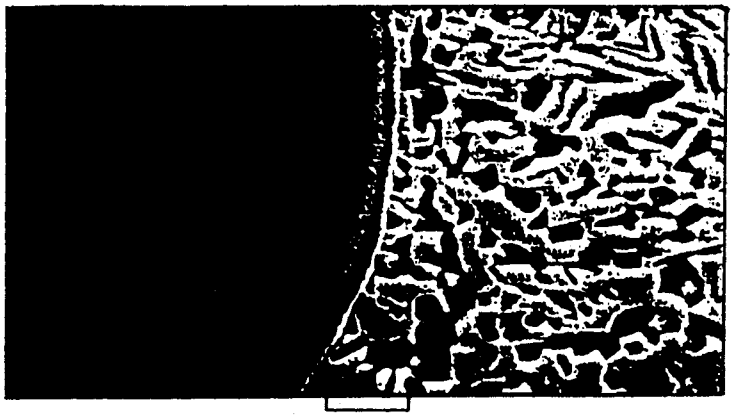
Figure 6A:
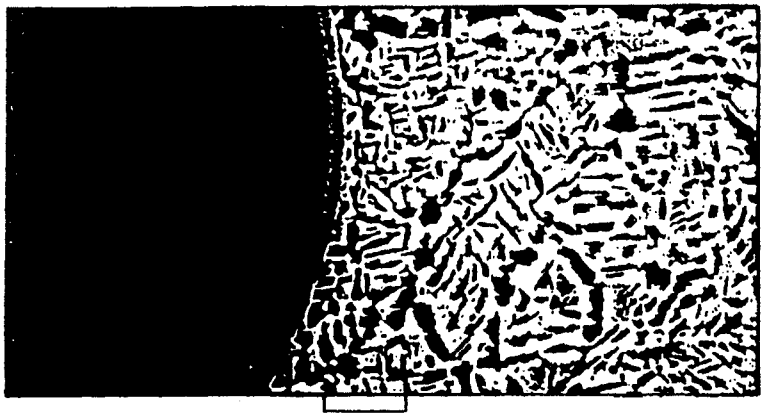

FIGS. 6(A) and 6(B) illustrate photomicrographs of Ti-25Al-11Nb-2.6Mo/SiC exposed at 800° C. for 50 hours and 1000° C. for 25 hours, respectively.

Figure 7B:
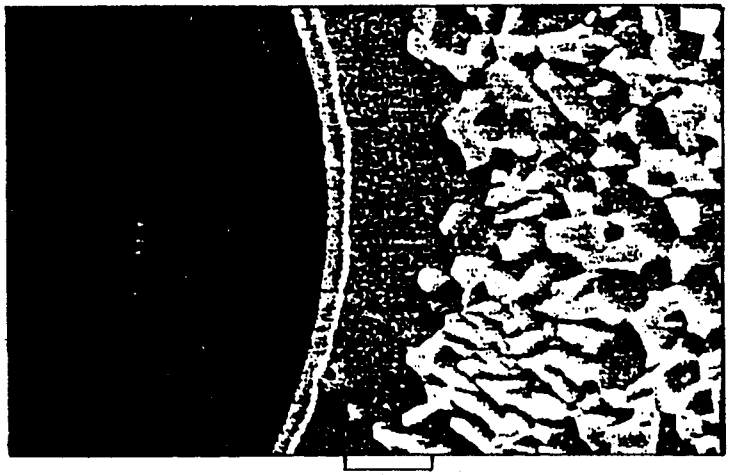
Figure 7A:
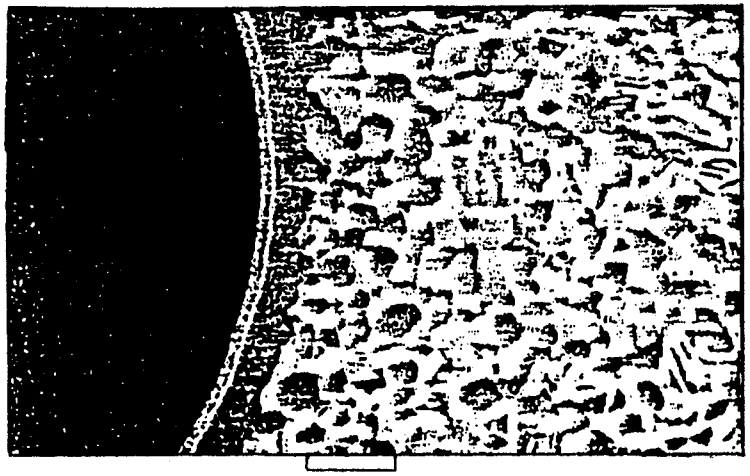

FIGS. 7(A) and 7(B) illustrate photomicrographs of Ti-26Al-16Nb/SiC at 800° C. for 50 hours and 1000° C. for 25 hours, respectively.

Figure 8:
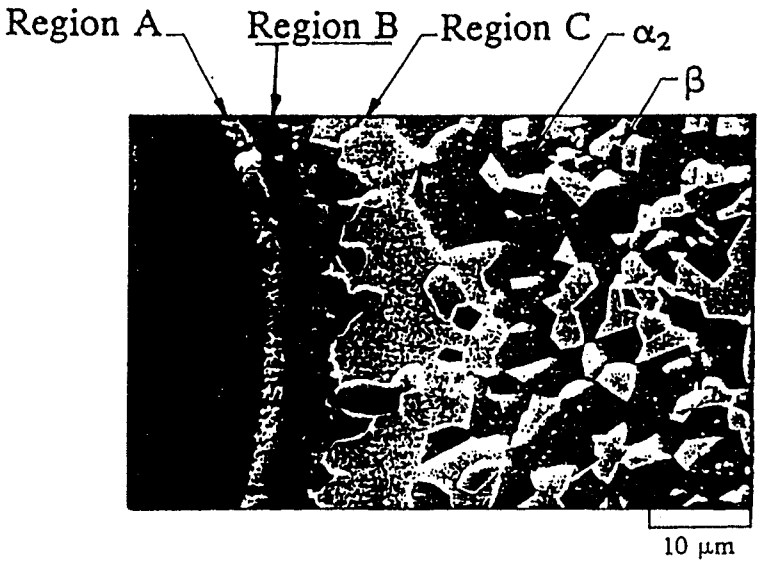

FIG. 8 illustrates a photomicrograph of Ti-25-Al-10Nb-3V-1Mo/SiC exposed at 1000° C. for 100 hours.

Figure 9B:
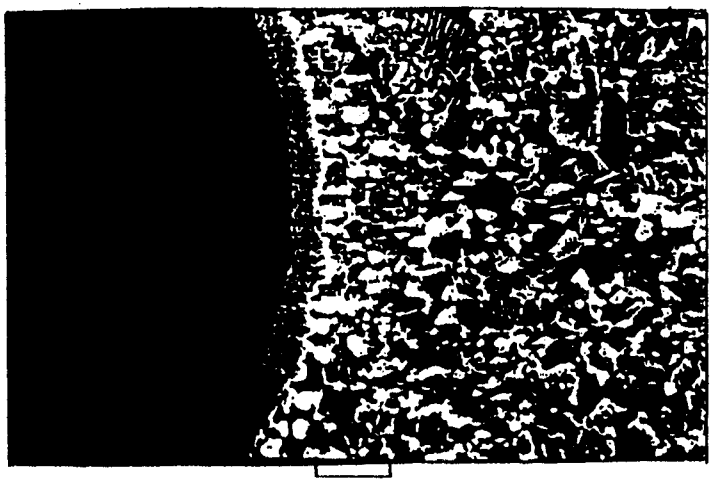
Figure 9A:
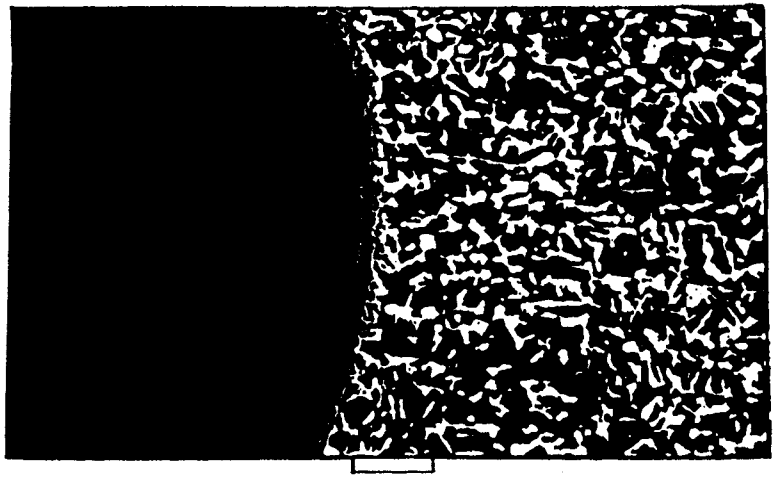

FIGS. 9(A) and 9(B) illustrate photomicrographs of Ti-25-10Nb-3V-1Mo exposed at 800° C. for 50 hours and 1000° C. for 25 hours, respectively.

DETAILED DESCRIPTION OF THE INVENTION

In the process of the present invention, titanium aluminide alloy foils are prepared comprising 70 to 80 atomic percent titanium, about 20 to 30 atomic percent aluminum, about 10 to 12 atomic percent niobium, and about 2 to 6 atomic percent of a member selected from a group consisting of molybdenum, tungsten, and vanadium and mixtures thereof. Alternatively, the composition can be provided as a powder.

Fiber materials suitable for use in the present invention are silicon carbide, silicon carbide-coated boron, boron carbide-coated boron, titanium boride-coated silicon carbide and silicon-coated silicon carbide, all of which are herewith referred to as "silicon carbide fibers". Other fibers manufactured from, for example, alumina or silicon nitride where the diffusing constituent creating the reaction zone at the interface of the fiber and the alloy matrix is not necessarily carbon, may nevertheless, shift stability to create depletion zones. The matrix alloys of the present invention, accordingly have applications in reducing, if not eliminating, depletion zones created by these fibers.

Preforms are prepared in any convenient manner such as laying a plurality of fibers onto a layer of the titanium aluminide alloy foil of the present invention, and repeating these steps as necessary to build up to the desired laminate preform. Alternatively, if desired, the alloy preform can be provided, in powder form, and consolidated with the fibers in a single step. The fibers need not be sacrificially pre-coated with extraneous Beta solution prior to consolidation with alloy powder of this invention.

Consolidation of the fiber and alloy preforms is accomplished by application of heat and pressure over a period of time during which the alloy material is superplastically formed into a matrix surrounding the fibers to completely embed them in the alloy matrix. Consolidation is carried out at a temperature range of from 0° to 250° C. below the Beta-transus temperature of the alloy. For example, the consolidation of a composite, comprising titanium aluminide alloys of the present invention, is characterized by a Beta-transus temperature of from about 1800° F. to about 1850° F. The pressure required for consolidation of the composite ranges from about 15 ksi to about 30 ksi and the time for consolidation ranges from about 2 hours to about 4 hours.

The titanium aluminide alloy matrices which contain the critical admixture of Beta stabilizing solutes do not form depleted zones. In this system, either a continuous Beta phase or a transformed Beta phase microstructure is stabilized at the fiber/matrix interface, with no evidence of microstructural changes favoring Alpha 2 during the interfacial chemical reactions.

One preferred embodiment of the present invention comprises 25 atomic percent aluminum, 11 atomic percent niobium and 2.6 atomic percent molybdenum within the titanium aluminide matrix foil. This alloy is an example of preserving discrete Beta regions along the interface where crack growth is arrested. However, a particularly preferred embodiment of the present invention in which it is possible to form a continuous Beta layer at the reaction zone/matrix alloy interface which completely prevents crack growth into the matrix comprises the formula (based on atomic percent) Ti-25Al-10Nb-3V-1Mo.

The following examples are illustrative of the invention:

EXAMPLE 1

Metal matrix composites were prepared from Ti-25 Al-11 Nb-2.6 Mo (atomic percent) foils and SCS-6 silicon carbide fibers. Consolidation of the composites was accomplished at 1000° C. for 2 hours at 15 ksi.

Figure 5A:
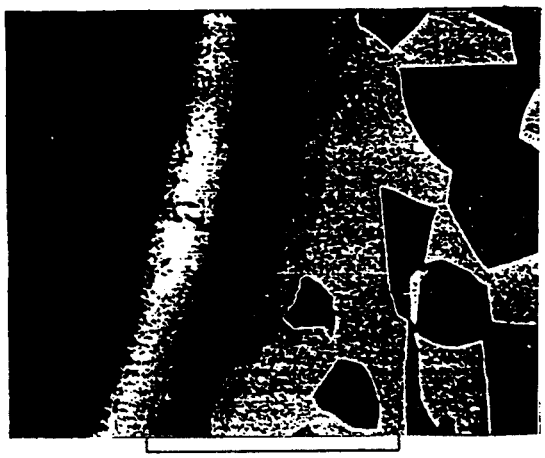
Figure 5B:
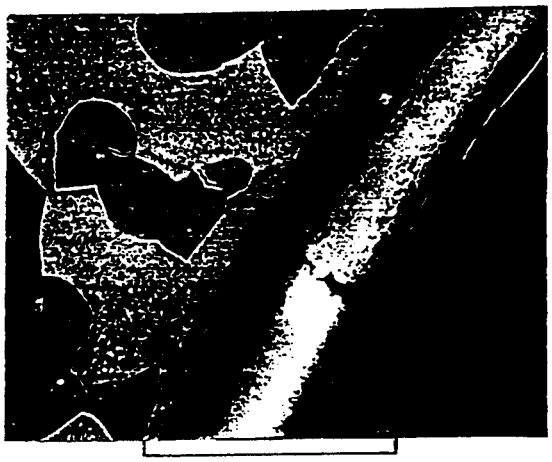

Referring to FIG. 5, a micrograph illustrates in FIG. 5*a* an interface where there is arrest of the interfacial crack by the Beta phase at the interface of the matrix and in FIG. 5*b*, there is illustrated crack growth and arrest underneath the Beta phase, in the Alpha 2 phase of the matrix microstructure. Although it appears to be skirting the edge of the Beta region, the crack is underneath the Beta region whose three-dimensional shape may not be readily apparent. It is readily apparent that there is in both FIGS. 5*a* and 5*b* a reaction zone, and thereafter the beginning of the matrices two-phase microstructure. Unlike the prior art, there is no depletion zone. The lighter color in the matrix microstructure is Beta phase material and the darker color is Alpha 2 phase material. It should be noted that at the beginning of the matrix microstructure the Beta phase material is thicker and more continuous.

EXAMPLE 2

Metal matrix composites were prepared in accordance with Example 1 except that there was no Molybdenum. The alloy contained the same Al and Ti amounts, and the normal transition metal amount of 11 atomic percent niobium. There was no other additional Beta stabilizing solute present in the alloy. Consolidation was achieved at the normal conditions for such composites.

Figure 2A:
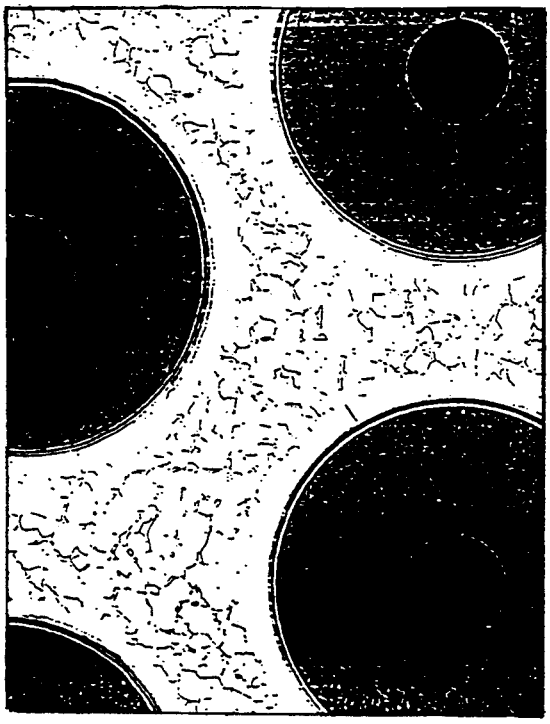
FIG. 2 shows a series of micrographs of a cross section of the composite material Ti-24 Al-11 Nb/SCS-6 SiC where there is illustrated degradation due to interfacial chemical interactions as follows.
Figure 2B:
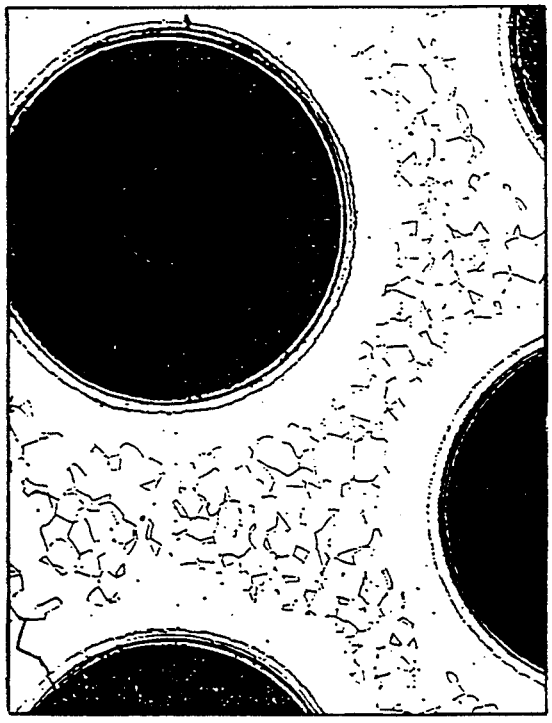
Figure 2C:
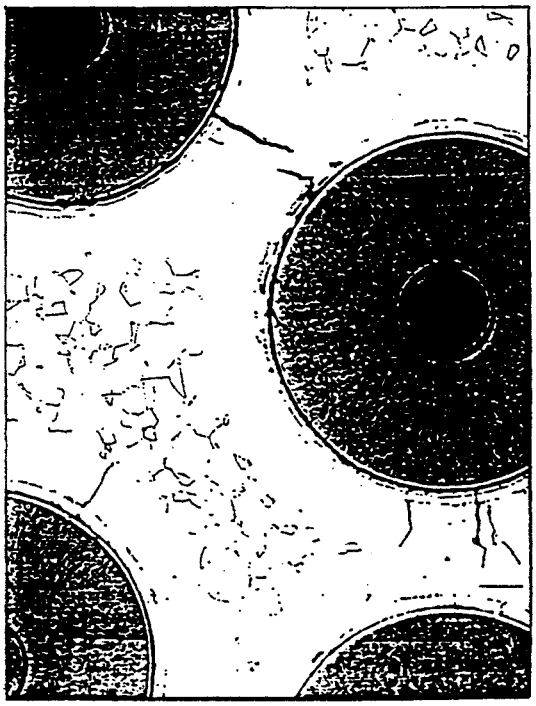
Figure 2D:
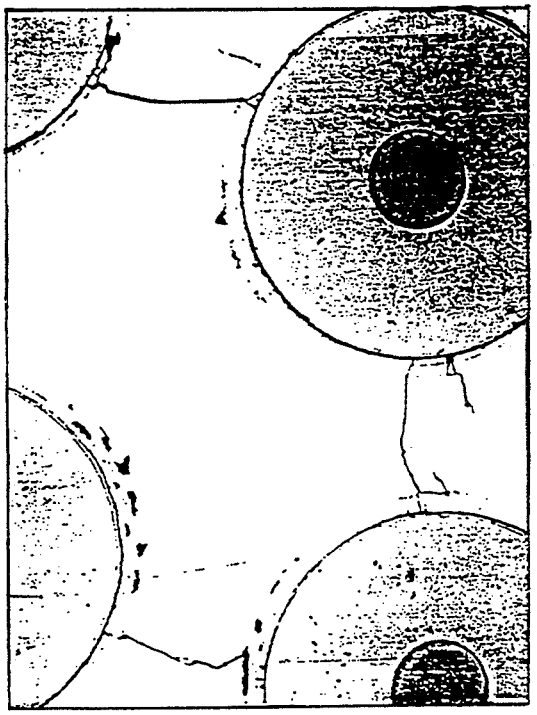

Referring to FIGS. 2*a, b, c* and *d*, the composites are illustrated in FIG. 2*a* as fabricated, FIG. 2*b* as thermally exposed to 1000° C. for twenty-four hours, FIG. 2*c* thermally exposed to 1000° C. for forty-eight hours, and FIG. 2*d* thermally exposed at 1000° C. for ninety-six hours. The reaction zones are surrounding each dark-colored fiber as a plurality of white rings. The next zone is the the white space enveloping the reaction zone. This is an essentially pure, ordered Alpha 2 region. It is the so-called depletion zone, having inherent low temperature brittleness and low crack resistance under thermal cycling conditions. This depleted zone grows essentially further and further into the matrix between the fibers as the thermal exposure is intensified from twenty-four hours to ninety-six hours. Note that after ninety-six hours (FIG. 2*d*) the matrix is essentially completely Alpha 2 region and that cracks may be propagated throughout the matrix and extend from one fiber reaction zone all the way to the next fiber reaction zone.

Also note that even in the as-fabricated composite shown in FIG. 2*a*, the amount of unaffected two-phase Alpha 2+Beta matrix remaining between adjacent fibers is sufficiently small that cracks can extend well into the matrix before being arrested by the Beta regions, such that the matrix is mostly cracked.

EXAMPLE 3

The compositions of Example 1, i.e., FIG. 5, containing the critical additional Beta solutes, for example, 2.6 atomic percent Molybdenum, are illustrated at FIGS. 6(A) and 6(B) to be exposed to 800° C. for 50 hours and 1000° C. for 25 hours, respectively. As contrasted with FIGS. 2*b* and 2*c*, FIGS. 6(A) and 6(B) show no depletion zone formation, but instead the two phase microstructure is adjacent to the reaction zone and there is no evidence of cracking. Clearly, the arresting of microcracks at FIG. 5 prevents the type of cracking shown in FIG. 2 from occurring in FIG. 6.

EXAMPLE 4

Figure 1:
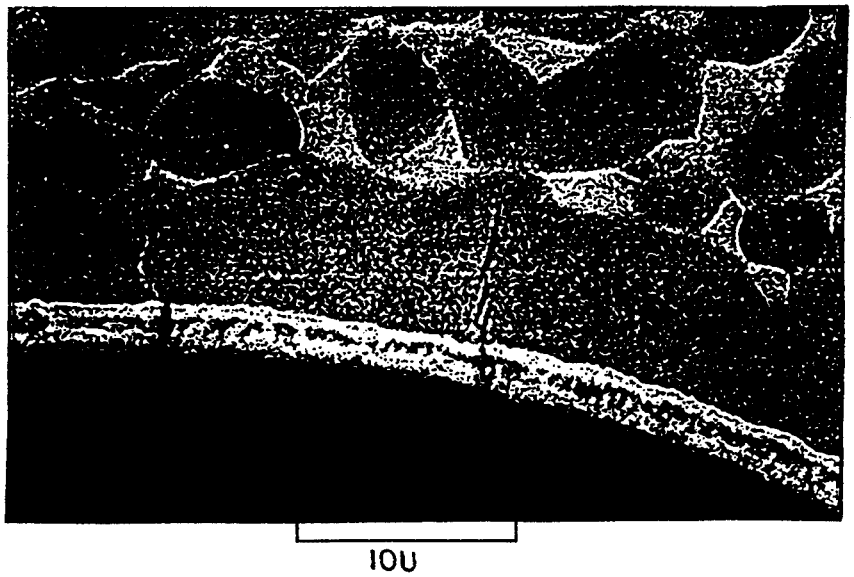
FIG. 1 is a micrograph of the interface formed between Ti-25Al-14Nb titanium aluminide matrix alloy and SCS-6 SiC fiber reinforcement.

Metal matrix composites shown in FIG. 1 were prepared in accordance with Example 2 except that 30% more than the normal amount of niobium was employed so that the amount of niobium was 14 atomic percent to enhance the formation of Beta phase.

Referring to FIG. 1, it is readily apparent that a depletion zone surrounds the reaction zone. This zone is essentially pure Alpha 2 region and is not unlike that depicted in Example 2. Although there is in FIG. 1's depletion zone a higher volume fraction of Beta material, such volume fraction is not sufficiently stabilized at the reaction zone/matrix interface to provide a continuous Beta zone. Microcracks can thus extend immediately from the reaction zone and propagate into the matrix Alpha 2 regions quite readily. The stability of the Beta phase is unchanged by additional volume fractions of niobium.

EXAMPLE 5

Metal matrix composites in FIGS. 3 and 7 were prepared in accordance with Examples 2 and 4 except that the Beta stabilizer modifying the alloy was in the amount of 16 atomic percent niobium. The amount of niobium was thus increased by over 40%. Although, once again, there is more volume fraction Beta material within the matrix, there is no continuous Beta nor transformed Beta region at the beginning of the matrix and cracks may propagate through the reaction zone and immediately into the matrix without much chance of encountering Beta upon entering the matrix. FIGS. 8A and B show progressive growth of the Beta depletion zone upon extended thermal exposure.

As may be readily seen from Examples 4 and 5, if compared to Example 2, increases in the niobium content of the matrix alloy can be used to increase the volume fraction of transformed Beta regions in the matrix microstructure, but as compared to Examples 1 and 3 are ineffective in preventing formation of depleted zones at the interface of the matrix and the reaction zone. This is the drawback in prior art U.S. Pat. Nos. 4,978,585; 5,030,277, 5,045,407; and 5,017,438 where the additional niobium content of the alloy merely increased the volume fraction of Beta phase. However, such volume fraction increase does not alone shift the stability towards the Beta phase, unlike the present invention. A pseudobinary titanium aluminide-niobium phase diagram is depicted at FIG. 4. Therein, it can be seen that as long as there is only Alpha 2 and Beta phase material present, the composition of Beta phase in equilibrium with the Alpha 2 phase at a particular consolidation temperature $T_c$ will always be the same regardless of the niobium content of the alloy. For example, an alloy of overall composition $X_1$, has relative amounts of Alpha 2 and Beta phases in accordance with the application of the Lever Rule as bd/ad and ab/ad, respectively. The compositions of these phases are shown on the diagram as $X_{alpha}$ and $X_{beta}$. Increasing the overall niobium content of the alloy to $X_2$ changes the volume fractions of Alpha 2 and Beta phases to cd/ad and ac/ad, respectively, but as we have shown does not change the relative stability of these two phases at the interface during consolidation temperatures. In other words, while the width of the depleted zone may be decreased by increasing the niobium content of the alloy, this is primarily a volume fraction effect. Since there is more Beta phase to be transformed by the interfacial reaction at a given time and temperature, the width of the depleted zone may be thinner.

EXAMPLE 6

Composites where the matrix alloy comprises Ti-25Al-10Nb-3V-1Mo reinforced by SiC fibers are prepared and exposed to temperatures of 800° C. for 50 hours, 1000° C. for 25 hours, 1000° C. for 100 hours were prepared and illustrated in FIGS. 8 and 9(A) and 9(B).

Not only is there no Beta depletion zone, but there is an essentially continuous conformal layer of Beta phase at the reaction zone/matrix interface.

We have surprisingly discovered alloy compositions which overpower interfacial reactions and ensure a Beta stable interface, and in some instances even form a continuous Beta layer, without adding an extraneous sacrificial amount of stabilizer onto the surface of the fiber. This represents an unexpected improvement while fulfilling a long felt need in the industry.

What is claimed is:

1. A method for forming an improved fiber reinforced titanium aluminide composite material which comprises;

providing a set of silicon carbide reinforcement filaments;

providing a titanium aluminide base alloy comprising from 64 to 60 atomic percent titanium, from 24 to 22 atomic percent aluminum, from 10 to 12 atomic percent niobium and from 2 to 6 atomic percent of a member selected from the group consisting of molybdenum tungsten, vanadium and mixtures thereof; and consolidation of the filaments enveloped within the alloy by heat and pressure, wherein the Beta phase depletion zone as a product of interfacial reaction is eliminated, thus negating the need for extraneous Beta-phase stabilization coatings or Beta-phase stabilization treatments at the fiber/alloy interface.

2. The method of claim 1 wherein alloy comprises 2 to 6 atomic per cent of a combination of vanadium and molybdenum.

3. The method of claim 1 wherein the alloy comprises 2.6 atomic percent molybdenum.

4. The method of claim 1 wherein the alloy is Ti-25 Al-11 Nb-2.6 Mo.

5. The method of claim 1 wherein the alloy is Ti-25 Al-10 Nb-3V-1Mo.

6. The method of claim 1 wherein the alloy is provided in the form of foils.

7. The method of claim 1 wherein the alloy is provided in the form of powder.

* * * * *